US009559407B2

(12) United States Patent
Van Dijk et al.

(10) Patent No.: US 9,559,407 B2
(45) Date of Patent: Jan. 31, 2017

(54) LIGHTING DEVICE AND LUMINAIRE COMPRISING AN ANTENNA

(71) Applicant: KONINKLIJKE PHILIPS N.V., Eindhoven (NL)

(72) Inventors: Nico Van Dijk, Eindhoven (NL); Henricus Mathijs Maria Creemers, Eindhoven (NL); Jaco Van Der Merwe, Kelpen-Oler (NL); Konika Banerjee, Waalre (NL); Dirk Jan Van Kaathoven, Eindhoven (NL); Lambertus Adrianus Marinus De Jong, Son (NL); Roger Henri Denker, Eindhoven (NL); Yacouba Louh, Eindhoven (NL); Marijn Geels, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/786,695

(22) PCT Filed: Apr. 21, 2014

(86) PCT No.: PCT/EP2014/058032

§ 371 (c)(1),
(2) Date: Oct. 23, 2015

(87) PCT Pub. No.: WO2014/173852

PCT Pub. Date: Oct. 30, 2014

(65) Prior Publication Data

US 2016/0072176 A1 Mar. 10, 2016

(30) Foreign Application Priority Data

Apr. 23, 2013 (EP) ..... 13164817

(51) Int. Cl.
*H01Q 1/24* (2006.01)
*H01Q 1/22* (2006.01)
(Continued)

(52) U.S. Cl.
CPC ..... *H01Q 1/24* (2013.01); *F21V 23/045* (2013.01); *F21V 29/70* (2015.01); *H01Q 1/02* (2013.01);
(Continued)

(58) Field of Classification Search
CPC ..... H01Q 1/24; H01Q 1/02; H01Q 9/16; H01Q 21/00; H01Q 1/22
(Continued)

(56) References Cited

U.S. PATENT DOCUMENTS 8,633,646 B2 * 1/2014 Molezion ..... H01Q 1/007 315/307
9,253,859 B2 * 2/2016 Chung ..... F21V 29/004
(Continued)

FOREIGN PATENT DOCUMENTS

GB 2483113 A 2/2012
JP 2011228130 A 11/2011
(Continued)

*Primary Examiner* — Huedung Mancuso

(57) ABSTRACT

The invention provides a lighting device (104) and a luminaire (200). The lighting device comprises a light emitter (110) thermally connected to a heat sink (120). The lighting device further comprises a communication circuit (130) coupled to the heat sink for transmitting and/or receiving a communication signal. A first conductive part (122) of the heat sink comprises at least a first pole (142) of a dipole antenna (140) for transmitting and/or receiving the communication signal via the heat sink. This first pole of the dipole antenna may be induced via a primary radiator (160) to activate the gap (170).

17 Claims, 11 Drawing Sheets

(51) Int. Cl.

| | |
|---|---|
| ***H01Q 1/44*** | (2006.01) |
| ***H01Q 9/38*** | (2006.01) |
| ***H01Q 13/16*** | (2006.01) |
| ***F21V 23/04*** | (2006.01) |
| ***F21V 29/70*** | (2015.01) |
| ***H01Q 1/02*** | (2006.01) |
| ***H01Q 9/16*** | (2006.01) |
| ***H01Q 21/00*** | (2006.01) |

(52) U.S. Cl.
CPC ..... *H01Q 1/44* (2013.01); *H01Q 9/16* (2013.01); *H01Q 9/38* (2013.01); *H01Q 13/16* (2013.01); *H01Q 21/00* (2013.01); *F21K 9/232* (2016.08)

(58) Field of Classification Search
USPC ..... 343/721
See application file for complete search history.

(56) References Cited

U.S. PATENT DOCUMENTS

| | | | | |
|---|---|---|---|---|
| 9,345,105 | B2 * | 5/2016 | De Jong | H01Q 1/22 |
| 9,404,624 | B2 * | 8/2016 | Chung | F21K 9/135 |
| 9,435,521 | B2 * | 9/2016 | Chen | F21V 23/006 |
| 2007/0007898 | A1 * | 1/2007 | Bruning | H05B 33/0821 315/34 |
| 2011/0006898 | A1 | 1/2011 | Kruest et al. | |
| 2012/0274208 | A1 | 11/2012 | Chen et al. | |
| 2012/0293652 | A1 | 11/2012 | Farmer | |
| 2013/0155664 | A1 | 6/2013 | Kim | |
| 2014/0021862 | A1 | 1/2014 | Chung | |

FOREIGN PATENT DOCUMENTS

| | | | |
|---|---|---|---|
| WO | 2008012533 | A1 | 1/2008 |
| WO | 2010140136 | A1 | 12/2010 |
| WO | 2012150589 | A1 | 11/2012 |

* cited by examiner

LIGHTING DEVICE AND LUMINAIRE COMPRISING AN ANTENNA

CROSS-REFERENCE TO PRIOR APPLICATIONS

This application is the U.S. National Phase application under 35 U.S.C. §371 of International Application No. PCT/EP2014/058032, filed on Apr. 21, 2014, which claims the benefit of European Patent Application No. 13164817.2, filed on Apr. 23, 2013. These applications are hereby incorporated by reference herein.

FIELD OF THE INVENTION

The invention relates to lighting device comprising an antenna. The invention further relates to a luminaire comprising the lighting device.

BACKGROUND OF THE INVENTION

Tele-management of light sources both for indoor and outdoor applications are increasingly popular. Intelligent lighting has become widespread, and RF communication is a powerful technology to be used in this tele-management of lamps, in particular for domestic and office environments. Instead of controlling the power supply to the lamp, the trend has moved towards directly controlling the light source or lighting device (for example an exchangeable element of the lamp) by sending an RF control signal to the lighting device.

One example of such light source comprising a luminescent material can be found in the published patent application US2012/0274208A1 which relates to a lighting device such as a replacement lighting device, comprising a light source (e.g. LED) for producing light. The lighting device further comprises a heat sink made of a material with an electrical resistivity being less than 0.01 Ωm (e.g. a metallic heat sink) which is part of the housing and transports heat away from the light source. A radio frequency communication circuit connected to an antenna serves to enable RF signal communication (e.g. to control the device via a remote control). The antenna is arranged at least 2 mm outside the heat sink.

A problem of this lighting device is that the required arrangement of the antenna may limit the applicable light power of the known lighting device.

SUMMARY OF THE INVENTION

One prior art US20110006898A1 discloses antennas can be formed on the heat sink and the antenna can be dipole, patch and slot antenna are formed on the heat sink (paragraph 0026, 0027 and 0033). But this prior art only propose such possibility without giving any practical and feasible way of implementing the antennas on a heat sink.

It is an object of the invention to provide a lighting device having RF communication in which the light emission power may be increased.

A first aspect of the invention provides a lighting device. A second aspect of the invention provides a luminaire. Advantageous embodiments are defined in the dependent claims.

A lighting device in accordance with the first aspect of the invention comprises a light emitter thermally connected to a heat sink. The lighting device further comprises a communication circuit coupled to the heat sink for transmitting and/or receiving a communication signal. A first conductive part of the heat sink comprises at least a first pole of a dipole antenna for transmitting and/or receiving the communication signal via the heat sink. In the arrangement of the lighting device according to the invention, the first conductive part of the heat sink constitutes at least one 'leg' or the first pole of the dipole antenna of the communication system. The communication circuit is coupled to the heat sink which may be a direct electrical connection or a capacitive coupling of the communication circuit to the heat sink. As a result, a volume of the overall heat sink may be increased without increasing the outer dimensions of the lighting device and without obstructing the transmission and/or receiving characteristics of the antenna. The first conductive part must be electrically conductive and may for example be made partially or wholly from metal or any other electrically conductive material. This enables to increase the efficiency of the heat dissipation to the environment of the heat sink, which again enables an increase in the light emission power of the lighting device while still being able to transmit and/or receive the communication signal. The first aspect further proposes forming the dipole antenna by a first radiator and a second radiator which is excited by the radiation from the first radiator. More specifically, the lighting device comprises a primary radiator arranged inside the heat sink and connected to the communication circuit for transmitting and/or receiving the communication signal inside the heat sink near a gap in the heat sink, the primary radiator being configured to activate the first conductive part around the gap to constitute a secondary radiator transmitting and/or receiving the communication signal outside the heat sink.

A trend in current industry is that lighting devices are becoming smaller and smaller. Because generally, the light emitters generate a significant amount of heat, cooling of the light emitter is a crucial problem which has to be solved to further miniaturize the lighting devices, while maintaining or even increasing the light emission power of these lighting devices. Especially when the light emitter is a semiconductor light emitter, such as a Light Emitting Diode (further also indicated as LED) or an Organic Light Emitting Diode (further also indicated as OLED), the outer dimensions may be decreased significantly, and may substantially only be limited by the required volume of the heat sink to ensure sufficient heat dissipation from the semiconductor light emitter. In the known lighting device, the antenna is arranged outside the heat sink to ensure that the antenna is not shielded from the electro-magnetic communication signal by the heat sink. However, this requirement will reduce the possible dimensions of the heat sink and thus will limit the light emission power of the known lighting device. The inventors have found that the heat sink may be used at least as part of a dipole antenna for transmitting and/or receiving the communication signal. This enables the lighting device according to the invention to increase the volume of the heat sink compared to the known configuration, and as such allow further increase of the light emission power in the lighting device while maintaining good communication.

Lighting devices according to the invention are often enclosed by some kind of housing, for example, in a luminaire. Such a housing typically limits the flow of air passing the heat sink and thus limits the heat flow from the heat sink to the environment. An important flow of heat from the heat sink to the environment in the housing is immediately at a light-emission opening of the housing from which the light is emitted by the lighting device. In the known lighting device the heat sink is arranged at least 2 mm away from the extending antenna, thus located away from the light-emission opening of the housing, which may reduce the heat flow from the heat sink to the environment via the light-emission opening. In the lighting device according to the invention at least a part of the dipole antenna is constituted by the first conductive part of the heat sink which enables the heat sink to extend up to the light-emission opening of the housing and as such enables relatively easy heat flow from the heat sink via the light-emission opening into the environment. This further improves the efficiency of the heat sink in the lighting device according to the invention which may also contribute to a possible increase in light emission power of the lighting device according to the invention.

Published UK patent application GB2483113 discloses that the lighting device may comprise a circuitry which includes communications circuitry for communicating with a remote device. This published patent application further discloses that the heat sink is arranged to act as an antenna for the communications circuitry. However, nowhere in this published patent application is disclosed how the heat sink may act as the antenna for the communications circuitry. In the lighting device according to the invention, at least part of the heat sink is used to realize at least one pole of a dipole antenna for transmitting and/or receiving the electro-magnetic communication signal. The communication circuit of the lighting device according to the invention is coupled to the first conductive part which comprises or constitutes at least the first pole of a dipole antenna such that the first conductive part at least contributes to a dipole antenna which has a resonance frequency including the signal frequency of the communication signal.

In an embodiment of the lighting device according to the invention, the communication circuit is connected to a first mono-pole antenna having a ground-plate being coupled to the first conductive part of the heat sink. The first mono-pole antenna may, for example, be a first chip antenna which comprises the first mono-pole antenna together with a ground-plate being an electrical ground plate. Such chip antennas are often available as Surface Mount Devices (further also indicated as SMD) which can be mounted on a Printed Circuit Board (further also indicated as PCB). Alternatively, the first mono-pole antenna may, for example, be a copper trace with predefined dimensions, printed on a PCB. To enable good transmission and/or receiving characteristics of this first mono-pole antenna, the electrical ground plate should be relatively strong or large ground plate. In operation, the first mono-pole antenna (for example of the chip antenna) induces a "copy" of the first mono-pole antenna into the electrical ground plate to generate the dipole antenna—similar as an image of an object is "copied" in a mirror. By coupling the ground-plate or electrical ground plate of the first mono-pole antenna to the first conductive part, the "copy" of the first mono-pole antenna is induced in the first conductive part. So this "copy" of the first mono-pole antenna, also indicated as the further mono-pole antenna, in the first conductive part together with the first mono-pole antenna (for example, of the first chip antenna) creates the dipole antenna for communication. So due to the coupling between the ground-plate of the first mono-pole antenna and the first conductive part of the heat sink, the further mono-pole antenna induced in the first conductive part constitutes the one pole of the dipole antenna according to the invention which, together with the first mono-pole antenna of the chip antenna constitutes the dipole antenna. The mono-pole antenna (for example, of the first chip antenna), together with the induced further mono-pole antenna in the first conductive part, have a resonance frequency which includes the signal frequency of the communication signal. So the coupling between the ground-plate of the first mono-pole antenna and the first conductive part ensures that one pole of the dipole antenna will be induced by the first mono-pole antenna (e.g. the chip antenna) in the first conductive part to cause the first conductive part to comprise one pole of the dipole antenna which contributes to the transmitting and/or receiving of the communication signal.

In the lighting device according to the invention, the first conductive part constitutes part of an outer wall of the heat sink, and the first mono-pole antenna is arranged inside the heat sink coupled to the first conductive part. The first mono-pole antenna again may be a first chip antenna. In such an embodiment, the first conductive part may, for example, be part of the light emission surface of the lighting device in which the first mono-pole antenna is arranged at the inside of the first conductive part. The upper part of the heat sink may, for example, comprise a metal cap being the first conductive part to which the first mono-pole antenna is coupled. So there is no external antenna necessary and/or visible to enable communication. One pole of the dipole antenna is induced in the first conductive part by the first mono-pole antenna (for example, the first chip antenna) and, as indicated before, the combination of this one pole and the first mono-pole antenna generates a dipole antenna suitable to transmit and/or receive the communication signal—whether the first mono-pole antenna is arranged inside the heat sink, or outside the heat sink. As such, as an alternative to the current embodiment, the first mono-pole antenna may also be coupled to the first conductive part of the heat sink while being arranged outside the heat sink.

In the lighting device according to the invention, the first conductive part is electrically insulated from the remainder of the heat sink via a coupling element. The coupling element may be made of any insulating material. When the first conductive part comprises at least the first pole of the dipole antenna, the communication circuit is coupled to the first conductive part such that the first conductive part at least contributes to the transmission and/or receiving of the communication signal. In view of safety regulations, it may be necessary to ensure that the first conductive part is insulated from the remainder of the heat sink. In such lighting device, the heat sink is typically electronically completely insulated from circuitry to ensure it is safe to touch. However, to allow the first pole of the dipole antenna to contribute to the communication, there has to be coupling to the communication circuit. This first pole of the dipole antenna is then often not fed directly from the communication circuit, but indirectly through a further coupling to further increase the safety of such lighting device and to comply to certain safety regulations.

In an embodiment of the lighting device, the lighting device comprises a second mono-pole antenna arranged at an angle compared to the first mono-pole antenna to improve communication via antenna diversity. Also this second mono-pole antenna may be a second chip antenna. The first mono-pole antenna and the second mono-pole antenna are often arranged perpendicular to each other, but the angle between the first mono-pole antenna and the second mono-pole antenna (or between the first chip antenna and the second chip antenna) may be different, depending on the exact local requirements. Antenna diversity is a well-known principle to improve the quality and reliability of a wireless link. The communication circuit may, for example, compare the signal strength of the communication signal received from the first mono-pole antenna with the communication signal received from the second mono-pole antenna to choose which to use. The first mono-pole antenna and the second mono-pole antenna both may be coupled to the first conductive part, or, alternatively, the first mono-pole antenna may be coupled to the first conductive part and the second mono-pole antenna may be coupled to a second conductive part, insulated from the first conductive part, but still part of the overall heat sink of the lighting device according to the invention.

In an embodiment of the lighting device, the lighting device comprises a primary radiator arranged inside the heat sink and connected to the communication circuit for transmitting and/or receiving the communication signal inside the heat sink near a gap in the heat sink. The primary radiator is configured to activate the first conductive part around the gap to constitute a secondary radiator transmitting and/or receiving the communication signal outside the heat sink. The gap substantially forms the secondary radiator which is "fed" by the electro-magnetic communication signal from the primary radiator inside the heat sink. The primary radiator typically is a dipole antenna and the electro-magnetic signal emitted by the primary radiator induces currents flowing around the gap and as such activates the first conductive part around the gap which subsequently starts to emit a similar communication signal. So the primary radiator activates the conductive material around the gap (including the first conductive part) and as such generates the second radiator (being the dipole antenna) which transmits and/or receives the communication signal outside the heat sink. So the first conductive part comprises at least the first pole of the dipole antenna.

In an embodiment of the lighting device, the primary radiator is a primary antenna arranged inside the heat sink. In such an embodiment the electro-magnetic communication signal emitted by the primary antenna induces a similar communication signal in the secondary radiator (around the gap) which emits the communication signal away from the heat sink. Alternatively, the lighting device comprises a transmission line coupled to the gap for transmitting the radiation of the primary radiator to the gap. Also the communication signal "transported" by the transmission line will induce a similar communication signal in the secondary radiator which is subsequently used to emit the communication signal from the heat sink. A width of the gap should be chosen to sustain an electric field across the gap, which may, for example, be less than 10 millimeter, but preferably only a few millimeters wide.

In an embodiment of the lighting device, the gap insulates the first conductive part from a second conductive part of the heat sink in which the primary radiator is configured to also activate the second conductive part around the gap for constituting a second pole of the dipole antenna. The second conductive part must be electrically conductive and may for example be made partially or wholly from metal or any other electrically conductive material. The second pole together with the first pole in the first conductive part constitutes a dipole antenna of the secondary radiator. As indicated before, the electro-magnetic signal emitted by the primary radiator induces currents flowing around the gap and as such activates the first conductive part and the second conductive part around the gap which subsequently starts to emit the similar communication signal. The first conductive part may, for example, have a first dimension substantially equal to a quarter wavelength of the communication signal or larger. This first dimension of the first conductive part may, for example, be a non-obstructed conductive surface which may be curved or even at an angle. Also the second conductive part may, for example, have a second dimension substantially equal to a quarter wavelength of the communication signal or larger. Preferably the second dimension substantially forms a straight line with the first dimension such that they individually each form a mono-pole on either side of the gap, and together form the dipole antenna of the secondary radiator.

In an embodiment of the lighting device, a resonance frequency of the combination of the first pole and the second pole includes a signal frequency of the communication signal. The communication signal induces a resonant current running in each of the first pole and the second pole of the dipole antenna. This current preferably is able to run relatively freely through the first conductive part and the second conductive part during the resonance of the communication signal, which may be achieved when the resonance frequency of the combination of the first pole and the second pole includes the signal frequency.

Optionally, a dimension and/or mass of the second conductive part is different compared to the first conductive part for adapting a polarization direction of the signal emitted from the heat sink. By changing a dimension of the first conductive part compared to the second conductive part, the polarization direction of the emitted signal and the sensitivity of the antenna for the polarization of the received signal may be adapted. Using such dimension and/or mass changes between the first conductive part and the second conductive part the heat sink may be adapted to comply with the local antenna requirements to have good communication.

In an embodiment of the lighting device, the gap comprises a slot in the first conductive part in which the slot is the secondary radiator which has a resonance frequency including the signal frequency of the communication signal. The slot will act as a dipole antenna which may, for example, be activated by the primary radiator such as the primary antenna inside the heat sink. A length of the gap is substantially equal to half of the wavelength of the communication signal, and a width of the gap is less than 5% of the wavelength of the communication signal. In such a configuration, the overall periphery of the gap is substantially equal to the wavelength of the communication signal to ensure that the gap will be able to resonate at the signal frequency of the communication signal.

In an embodiment of the lighting device, the slot comprises a signal feed for feeding the communication signal to the slot. This signal feed may be located, for example, near a center of the slot (the center of the slot being halfway the slot along the length direction of the slot), but preferably not exactly at the center of the slot. When locating the signal feed exactly at the center of the slot, the impedance of the antenna will be significantly increased. As the impedance of the signal source (in this case the communication circuit) preferably matches the impedance of the antenna, a significant increase of the antenna impedance is not preferred. As such, the location of the signal feed may be adapted such that the impedance of the antenna substantially matches the impedance of the communication circuit.

In an embodiment of the lighting device, the first conductive part comprises a further slot having similar dimensions as the slot for generating an antenna array. Such an antenna array may be used to shape the pattern of the Electro-Magnetic communication signal emission characteristic of the overall lighting device, but may also be used as antenna diversity to improve the communication with the lighting device—this depends on the positioning of the further slot compared to the slot in the first conductive part.

The lighting device according to the invention may also comprise a control circuit for controlling the lighting device in response to the received communication signal. Such control circuit may be configured for controlling a functioning of the lighting device, the functioning of the lighting device being selected from a list comprising: on-switching, off-switching, dimming, changing color, timing the on-switching, timing the off-switching, changing focus of the emitted light, controlling beam angle, estimating life-time, consumption of power, detecting failure, identification.

The lighting device according to the invention may also comprise an outer shape arranged to cooperate with light-mounting constructions selected from the list comprising: E27, E14, E40, B22, GU-10, GZ10, G4, GY6.35, G8.5, BA15d, B15, G53, PAR, and GU5.3.

In a further embodiment, the heat sink comprising a first plane and a second plane angled with respect to the first plane, and the slot is extending from the first plane to the second plane. In this embodiment, the directivity of the antenna can be improved.

In a further embodiment, the heat sink comprising a back plane opposite the slot and the primary radiator, and the distance between the back plane and the primary radiator is quarter of the wavelength of the communication signal. In this embodiment, the back plane can be used to resonate the radiation from the primary radiator back, thus the radiation of the primary radiator can be improved and in turn the performance of the second radiator is also improved. In a still further embodiment, the primary radiator is placed at the middle of the length of the slot.

In a still further embodiment, the heat sink is of a cylinder shape, and the slot extends from the lateral wall to the top wall of the cylinder heat sink. This embodiment provides a more specific structure. Also, the volume of the cavity influences the antenna bandwidth, a larger the volume yields a higher bandwidth.

In a further embodiment, the lighting device comprises dielectric material between the primary radiator and the back plane. Also the material within the cavity will influence the resonant length of the slot. A higher dielectric medium reduces the resonant length of slot, allowing for a smaller antenna. The tradeoff is that the bandwidth and efficiency typically decrease with a dielectric cavity medium.

The luminaire according to the second aspect comprises the light device according to the invention.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the color conversion arrangement, the lighting unit and the solid state light emitter package, which correspond to the described modifications and variations of the color conversion arrangement, can be carried out by a person skilled in the art on the basis of the present description.

Figure 1:
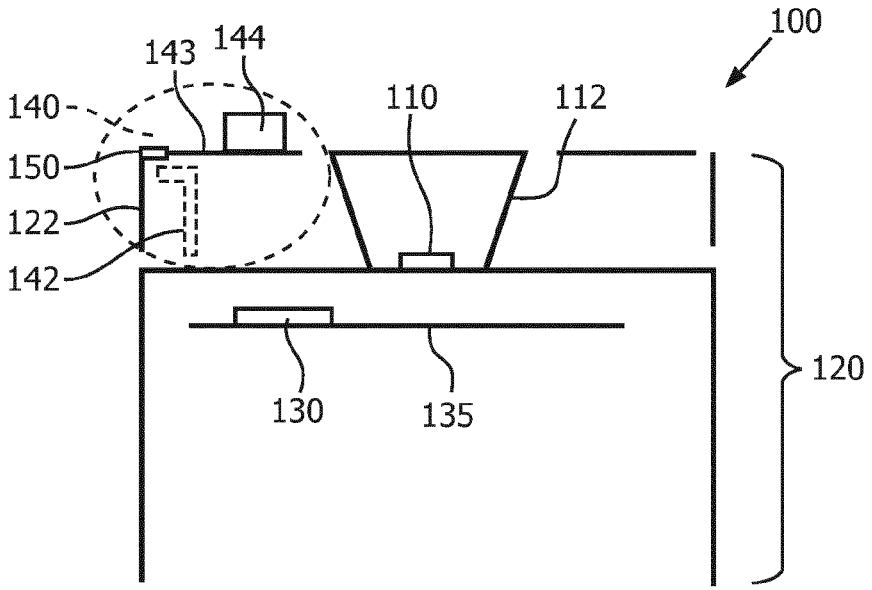
FIG. 1 shows a schematic cross-sectional view of a first embodiment of the lighting device according to the invention.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

FIG. 1 shows a schematic cross-sectional view of a first embodiment of the lighting device 100 according to the invention. This first lighting device comprises a light emitter 110 thermally connected to a heat sink 120 and comprises a communication circuit 130 arranged on a Printed Circuit Board (further also indicated as PCB) 135 for transmitting and/or receiving a communication signal. The heat sink 120 comprises a first conductive part 122 which comprises a first chip antenna 144 which is a first mono-pole antenna 144. Such first chip antenna 144 may be a commercially available chip antenna, often available as Surface Mount Devices (further also indicated as SMD) which can be mounted on a Printed Circuit Board (further also indicated as PCB). Alternatively, the first mono-pole antenna 144 may, for example, be a copper trace with predefined dimensions, printed on a PCB. The first conductive part 122 must be electrically conductive and may for example be made partially or wholly from metal or any other electrically conductive material. The first mono-pole antenna 144 is coupled with its ground plate (being an electrical ground plate 143) to the first conductive part 122 of the heat sink 120. This coupling of the ground plate 143 of the first mono-pole antenna 144 (or first chip antenna 144) to the first conductive part 122 ensures that a first pole 142 of a dipole antenna 140 is induced by the first mono-pole antenna 144 (being the first chip antenna 144) in the first conductive part 122. In operation, the first mono-pole antenna 144 or the first chip antenna 144 induces a "copy" of the first mono-pole antenna 144 into the electrical ground plate 143 to generate the dipole antenna 140—similar as an image of an object is "copied" in a mirror. By coupling the ground-plate 143 or electrical ground plate 143 of the first mono-pole antenna 144 to the first conductive part 122, the "copy" of the first mono-pole antenna 144 is induced in the first conductive part 122. This causes the first conductive part 122 to comprise at least one pole 142 (or one 'leg') of the dipole antenna 140. The first mono-pole antenna 144 constitutes a second pole of the dipole antenna 140 and as such the combination of the first mono-pole antenna 144 (or first chip antenna 144) and the first conductive part 122 of the heat sink 120 together form the dipole antenna 140.

The lighting device 100 as shown in FIG. 1 further comprises a collimator 112 and further comprises a coupling element 150. The collimator 112 is optional and is used to shape the light emitted by the light emitter 110 to a desired shape and may comprise any collimator type known in the art. The coupling element 150 may be required in view of safety regulations. Because of these safety regulations, it may be necessary to ensure that the first conductive part 122 is insulated from the remainder of the heat sink 120 such that the remainder of the heat sink 120 is safe to touch. The heat sink 120 is typically electronically completely insulated from any circuitry to ensure it is safe to touch. However, to allow the first pole 142 of the dipole antenna 140 to contribute to the communication, there has to be coupling between the first conductive part 122 and the communication circuit 130. This first pole 142 of the dipole antenna 140 is then often not fed directly from the communication circuit 130, but indirectly through a further coupling to further increase the safety of such lighting device 100. In the current embodiment, the further coupling is done via the ground plate 143 of the first chip antenna 144. Typically the currents running through the first conductive part 122 in operation should be low enough that it is safe to touch in any circumstances. However, in view of some regulations it may still be necessary to include the coupling element 150.

In the embodiment of the lighting device 100 shown in FIG. 1, there is no connection indicated between the communication circuit 130 and the first chip antenna 144 (or first mono-pole antenna 144) for clarity reasons. However, it is clear to a person skilled in the art that the communication circuit 130 should be connected to the first chip antenna 144 to ensure that the communication signal is transmitted and/or received via the dipole antenna 140. Also, in the embodiment shown in FIG. 1, the first chip antenna 144 (or first mono-pole antenna 144) is arranged at an outside surface of the heat sink 120. However, the first chip antenna 144 (or first mono-pole antenna 144) may also be arranged inside the heat sink 120, for example, on an opposite side of the first conductive part 122 as shown in FIG. 1.

Figure 2:
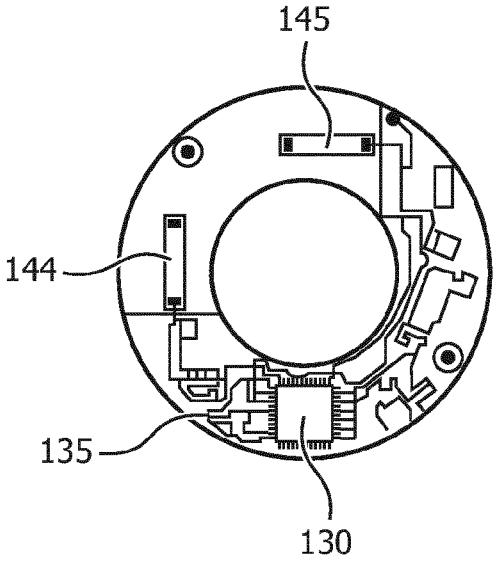
FIG. 2 shows a schematic view of a Printed Circuit Board for the first embodiment of the lighting device according to the invention.

FIG. 2 shows a schematic view of a Printed Circuit Board 135 of the first embodiment of the lighting device 100 according to the invention. Next to the communication circuit 130, the schematic view of FIG. 2 also shows the first chip antenna 144 (or first mono-pole antenna 144) and a second chip antenna 145 (or a second mono-pole antenna 145). Between the first chip antenna 144 and the PCB 135 the first conductive part 122 should be arranged but is left out for clarity reasons. The second chip antenna 145 may also be coupled to the same first conductive part 122 or may be coupled to a further metal part (not shown) as part of the heat sink 120.

The first chip antenna 144 (or first mono-pole antenna 144) and the second chip antenna 145 (or second mono-pole antenna 145) are arranged substantially perpendicular to each other, however the angle between the first chip antenna 144 and the second chip antenna 145 may be different, depending on the exact local requirements. Antenna diversity is a well-known principle to improve the quality and reliability of a wireless link. The communication circuit may, for example, compare the signal strength of the communication signal received from the first chip antenna 144 with the communication signal received from the second chip antenna 145 to choose which one to use to have the best communication.

Figure 3:
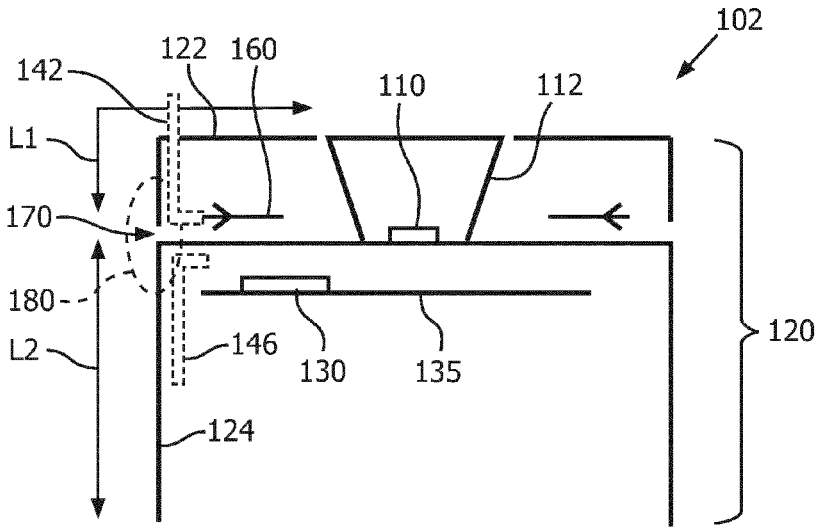
FIG. 3 shows a schematic cross-sectional view of a second embodiment of the lighting device according to the invention.

FIG. 3 shows a schematic cross-sectional view of a second embodiment of the lighting device 102 according to the invention. The lighting device 102 shown in FIG. 3 also comprises the light emitter 110, heat sink 120, PCB 135 and communication circuit 130, similar as the embodiment shown in FIG. 1. Also the optional collimator 112 is shown in FIG. 3. The lighting device 102 in FIG. 3 further comprises a primary radiator 160 (two are drawn in FIG. 3, but only one has a label 160) arranged inside the heat sink 120 and configured for activating the first conductive part 122 around a gap 170 between the first conductive part 122 and the remainder of the heat sink 120. The primary radiator 160 typically is a dipole antenna 160 and the electro-magnetic signal emitted by the primary radiator 160 induces currents flowing around the gap 170 and as such activates the first conductive part 122 around the gap 170 which subsequently starts to emit a similar communication signal. So the primary radiator 160 activates the conductive material around the gap 170 (including the first conductive part 122) and as such generates the second radiator 180 (being the dipole antenna) which transmits and/or receives the communication signal outside the heat sink 120. This activation of the first conductive part 122 causes the first conductive part 122 to comprise the first pole 142 of the dipole antenna 140 (not indicated) if a first dimension L1 of the first conductive part 122 is substantially equal to a quarter of the wavelength of the communication signal, or larger. The gap 170 substantially forms a secondary radiator 180 (indicated with a dashed oval). A width of the gap 170 should be chosen to sustain an electric field across the gap 170, which may, for example, be less than 10 millimeter, but preferably only a few millimeters wide. The gap 170 insulates the first conductive part 122 from a second conductive part 124 of the heat sink 120 (the second conductive part 124 may also be the remainder of the heat sink 120) in which the primary radiator 160 is configured to also activate the second conductive part 124 around the gap 170 to constitute a second pole 146 of the dipole antenna 140 (not specifically indicted) of the secondary radiator 180. The second conductive part 124 must be electrically conductive and may for example be made partially or wholly from metal or any other electrically conductive material. The second pole 146 in the second conductive part 124 together with the first pole 142 in the first conductive part 122 constitutes a dipole antenna 140 of the secondary radiator 180. As indicated before, the first conductive part 122 may, for example, have the first dimension L1 substantially equal to the quarter wavelength of the communication signal or larger. This first dimension L1 of the first conductive part 122 may, for example, be a non-obstructed conductive surface which may be curved or even at an angle (as indicated with the angled double arrow in FIG. 3). Also the second conductive part 124 may, for example, have a second dimension L2 substantially equal to a quarter wavelength of the communication signal or larger. Preferably the second dimension L2 substantially forms a straight line with the first dimension L1 such that they individually each form a pole on either side of the gap 170, and together form the dipole antenna 140 of the secondary radiator 180.

A resonance frequency of the combination of the first pole 142 and the second pole 146 includes a signal frequency of the communication signal. The communication signal induces a resonant current running in each of the first pole 142 and the second pole 146 of the dipole antenna 140 (not specifically indicated). This current preferably is able to run relatively freely through the first conductive part 122 and the second conductive part 124 during the resonance of the communication signal, which may be achieved when the resonance frequency of the combination of the first pole 142 and the second pole 146 includes the signal frequency. Optionally, a dimension and/or mass of the second conductive part 124 may be different compared to the dimension and/or mass first conductive part 122 for adapting a polarization direction of the signal emitted from the heat sink 120. By changing a dimension of the first conductive part 122 compared to the second conductive part 124, the polarization direction of the emitted signal and the sensitivity of the antenna for the polarization of the received signal may be adapted. Using such dimension and/or mass changes between the first conductive part 122 and the second conductive part 124 the heat sink 120 may be adapted to comply with the local antenna requirements to have good communication.

In the embodiment shown in FIG. 3, the primary radiator 160 is a primary antenna 160 arranged inside the heat sink 120. Alternatively, the lighting device 102 may comprise a kind of transmission line (similar to the one shown in FIG. 6) coupled to the gap 170 for transmitting the radiation of the primary radiator to the gap 170.

Figure 4:
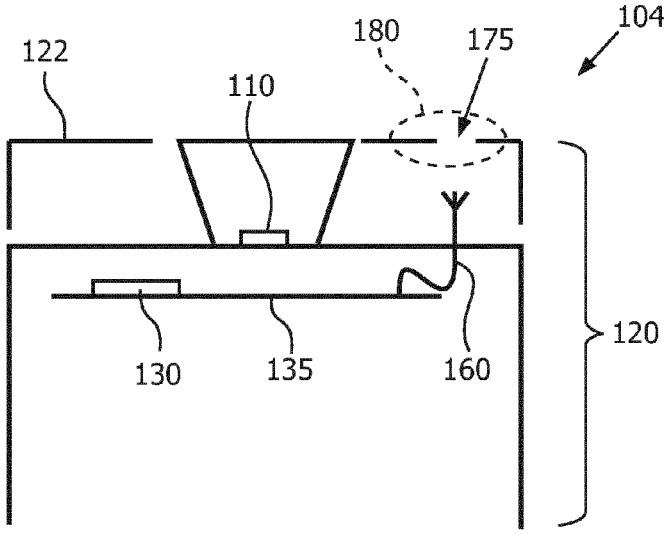
FIG. 4 shows a schematic cross-sectional view of a third embodiment of the lighting device according to the invention.

FIG. 4 shows a schematic cross-sectional view of a third embodiment of the lighting device 104 according to the invention. Also in the embodiment shown in FIG. 4, the light emitter 110, heat sink 120, PCB 135 and communication circuit 130 are shown, similar as the embodiment of FIG. 1. However, now, the gap in the first conductive part 122 comprises a slot 175 being an opening completely surrounded by the first conductive part 122. This slot 175 is the secondary radiator 180 (again indicated with a dotted oval) which has a resonance frequency including the signal frequency of the communication signal. The slot 175 acts as the dipole antenna 140 which may, for example, be activated by the primary radiator 160 such as the primary antenna 160 inside the heat sink 120. Again, the electro-magnetic signal emitted by the primary antenna 160 induces currents flowing around the slot 175 and as such activates the first conductive part 122 around the slot 175 which subsequently starts to emit a similar communication signal. So the primary antenna 160 activates the conductive material around the slot 175 and as such generates the second radiator 180 which transmits and/or receives the communication signal outside the heat sink 120. A length of the gap 175 or slot 175 is substantially equal to half of the wavelength of the communication signal, and a width of the gap 175 or slot 175 is less than 5% of the wavelength of the communication signal. In such a configuration, the overall periphery of the gap 175 or slot 175 is substantially equal to the wavelength of the communication signal to ensure that the gap 175 or slot 175 will be able to resonate at the signal frequency of the communication signal.

In an embodiment of the lighting device 104, the first conductive part 122 may comprise a further slot (not indicated) having similar dimensions as the slot 175 for generating a further antenna (also not indicated). Such a further antenna may form an antenna array (not shown) and may be used to shape an emission characteristic of the communication signal of the overall lighting device 104. Alternatively, the further antenna may also be used in an antenna diversity scheme (similar to the first chip antenna 144 and second chip antenna 145 in FIG. 2) to improve the communication with the lighting device 104. Whether the further antenna is used to shape the emission characteristic of the communication signal or contributes to the antenna diversity scheme depends on the positioning of the further slot compared to the slot 175 in the first conductive part 122.

Figure 5:
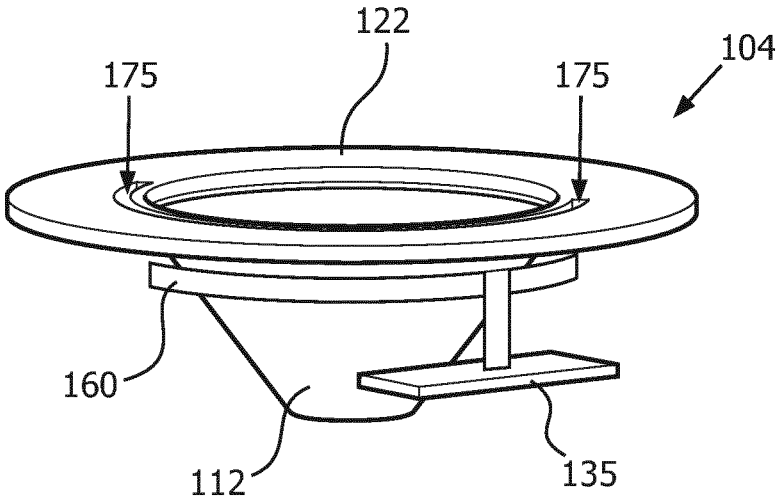
FIG. 5 shows a schematic plan-view of the third embodiment of the lighting device.

FIG. 5 shows a schematic plan-view of the third embodiment of the lighting device 104 (similar as shown in FIG. 4). In FIG. 5 the collimator 112 and the first conductive part 122 are shown, together with the slot 175. Underneath the slot 175 and inside the heat sink 120 the primary radiator 160 is shown as a primary antenna 160 connected to the PCB 135. As can be seen from the plan-view in FIG. 5, the slot 175 may be curved (as shown in FIG. 5) or may have substantially any other shape, as long as the overall periphery of the slot 175 is substantially equal to the wavelength of the communication signal to ensure that the slot 175 will be able to resonate at the signal frequency of the communication signal.

Figure 6:
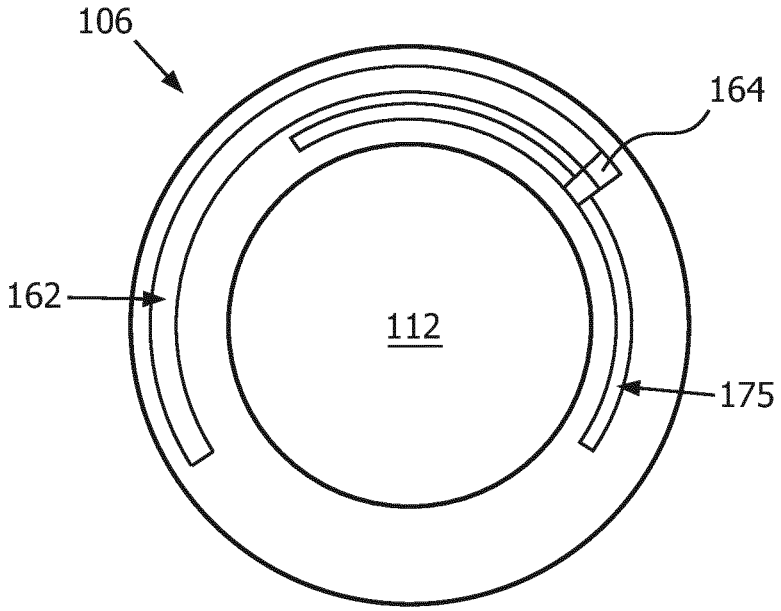
FIG. 6 shows a schematic top-view of a fourth embodiment of the lighting device.

FIG. 6 shows a schematic top-view of a fourth embodiment of the lighting device 106 in which the collimator 112 and the slot 175 are shown together with a signal feed 164 connected to a transmission line 162 for transmitting the radiation of the primary radiator (not shown) to the slot 175. This signal feed 164 may be located, for example, near a center of the slot 175 (the center of the slot 175 being halfway the slot 175 along a length direction of the slot 175), but preferably not exactly at the center of the slot 175. When locating the signal feed 164 exactly at the center of the slot 175, the impedance of the antenna will be significantly increased. As the impedance of the signal source (in this case the communication circuit 130) preferably matches the impedance of the dipole antenna 140 (constituted by the slot 175), a significant increase of the antenna impedance is not preferred. As such, the location of the signal feed 164 may be adapted such that the impedance of the dipole antenna 140 substantially matches the impedance of the communication circuit 130.

The lighting device 100, 102, 104, 106 according to the invention may also comprise a control circuit (not shown) for controlling the lighting device 100, 102, 104, 106 in response to the received communication signal. Such control circuit may be configured for controlling a functioning of the lighting device 100, 102, 104, 106. The functioning of the lighting device 100, 102, 104, 106 may be selected from a list comprising: on-switching, off-switching, dimming, changing color, timing the on-switching, timing the off-switching, changing focus of the emitted light, controlling beam angle, estimating life-time, consumption of power, detecting failure, identification. The lighting device 100, 102, 104, 106 according to the invention may also comprise an outer shape (not shown) arranged to cooperate with light-mounting constructions selected from the list comprising: E27, E14, E40, B22, GU-10, GZ10, G4, GY6.35, G8.5, BA15d, B15, G53, PAR, and GU5.3.

Figure 7:
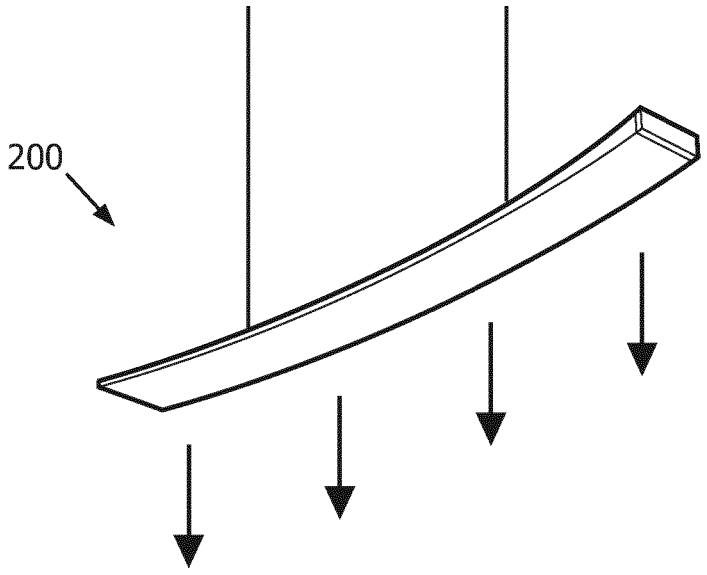
FIG. 7 shows a schematic plan-view of a luminaire according to the invention.

FIG. 7 shows a schematic plan-view of a luminaire 200 according to the invention. The luminaire 200 comprises, for example, light mounting constructions which can cooperate with the outer dimensions of the lighting device 100, 102, 104, 106 such that the lighting device 100, 102, 104, 106 may be fit into the luminaire 200.

FIGS. 8 to 16 show another embodiment of the invention, in which a slot is formed consecutively on angled planes of the heat sink, in order to improve the directivity of antenna. Basically, the heat sink comprising a first plane and a second plane angled with respect to the first plane, and the slot is extending from the first plane to the second plane.

Figure 8:
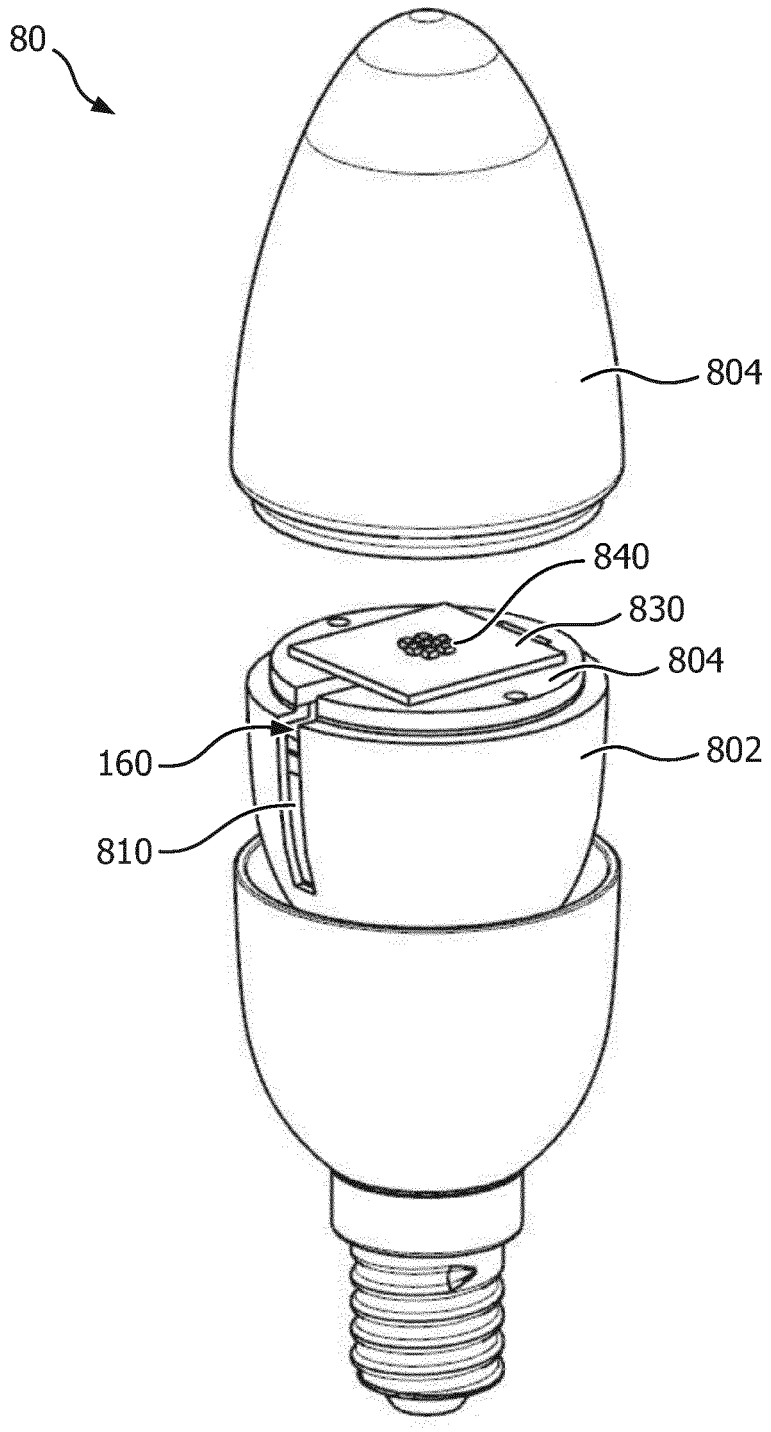
FIG. 8 shows a 3D the heat sink with the slot antenna and the feed line according to another embodiment of the invention, and the heat sink is integrated into a LED lamp.

The heat sink can be a cylinder shape. Such cylinder shape intends to cover a shape with the same diameter along its cross section plane, and a shape with incremental diameter along its cross section plane which can also be called as cup shape, as shown in FIG. 8. It should be noted that the shape of the heat sink is not limited as cylinder shape, any shape with a first plane and an intersecting and angled second plane is applicable.

Figure 8A:
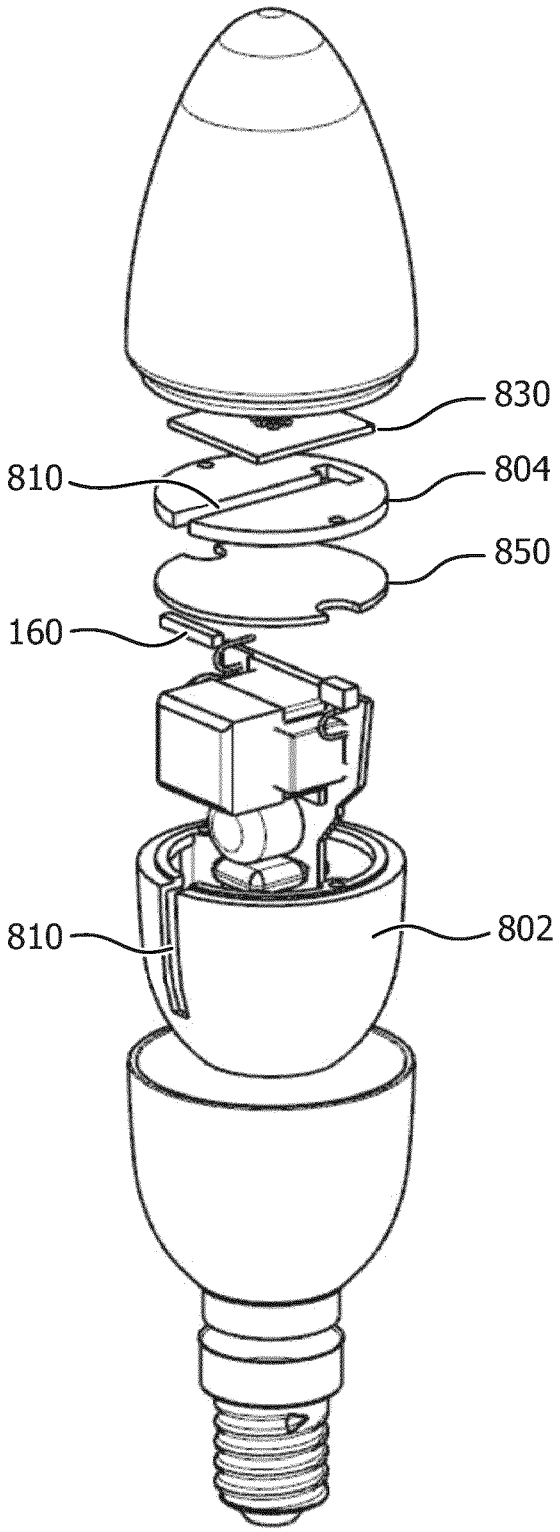
FIG. 8*a* is an exploded view of the LED lamp of FIG. 8.

In FIGS. 8 and 8*a*, the LED lamp 80 comprises the heat sink 800. With respect to the orientation in FIG. 8, the upper end of the heat sink 800 is enclosed or partly enclosed by an upper cap 804, also used as a heat spreader coupled to the ceramic board 830 of the LED chip 840. The upper cap 804 cools the LED chip by conducting the heat away and to the lateral wall 802, and the cap 804 and lateral wall 802 dissipate the heat to the atmosphere. A slot 810 extends from the lateral wall 802 to the upper cap 804 of the heat sink 800. Such heat sink 800 can be made as an integral part and be cut to form such slot. Alternatively, the lateral wall 802 and the upper cap 804 can be made as separate part, and are assembled together, while the slot is formed on the separate wall 802 and cap 804 or can be formed after they are assembled, as shown in FIG. 8*a*.

Preferably, for an evenly distribution of the radiation, the overall length of the slot is divided on the lateral wall 802 and the cap 804 half by half. Alternatively, the length division can also be varied according to practical needs. For example, if more radiation is desired on the lateral side, the length on the lateral wall 802 can be bigger than that on the upper cap 804.

In an implementation, the heat sink 900 is made of aluminum. And the narrow slot 910 is approximately 5 mm wide and 50 mm long. The slot acts as antenna. The dimensions of the slot are chosen such that it acts as a radiator of electrical field (g) at the frequencies of interest (e.g. the ZigBee band). The length of the slot needs to be well defined as approximately half wavelength of the desired radiation.

Also shown in FIG. 8, a feed line 160 as the primary radiator and the PCB 850 carrying the RF circuit connected to the feed line 160 are placed inside the heat sink 800 near the upper cap 804. The feed line 160 is placed approximate the middle of the total length of the slot 810. The feed line 160 acts as RF feed by coupling to the slot 810. The distance from RF feed to end of the slot primarily defines the antenna impedance. The width of the slot has a secondary effect, which is that width of the slot influences the antenna impedance by maximum 20%, while the distance from RF feed to end of slot defines in the order of 0% the antenna impedance.

Practically, as shown in FIGS. 8 and 8*a*, the feed line 160 is a line extending out of the PCB where the RF circuit is placed. Alternatively, the feed line 160 can be a trace antenna formed by a trace printed on the PCB with the suitable length and width. How to configure the feed line 160 is common knowledge for those skilled in the art and the specification will not give unnecessary details.

Figure 9:
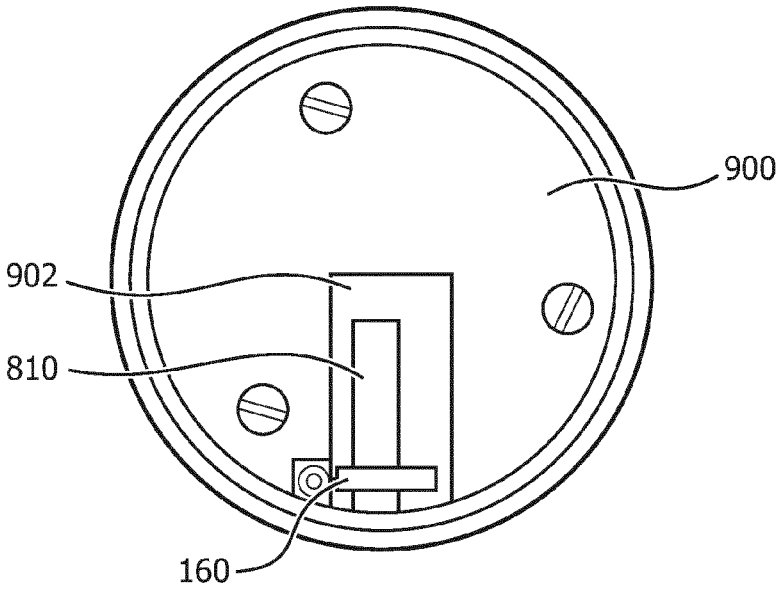
FIG. 9 shows a bottom view of the heat sink of FIG. 8.

Practically, if the PCB is below the slot on the upper cap 804, as shown in the bottom view in FIG. 9, to avoid interfere with the slot antenna, there is an opening 902 of the ground plane 900 on the PCB below the slot 810 on the upper cap 804. Such opening 902 is also around the feed line 160.

Figure 10:
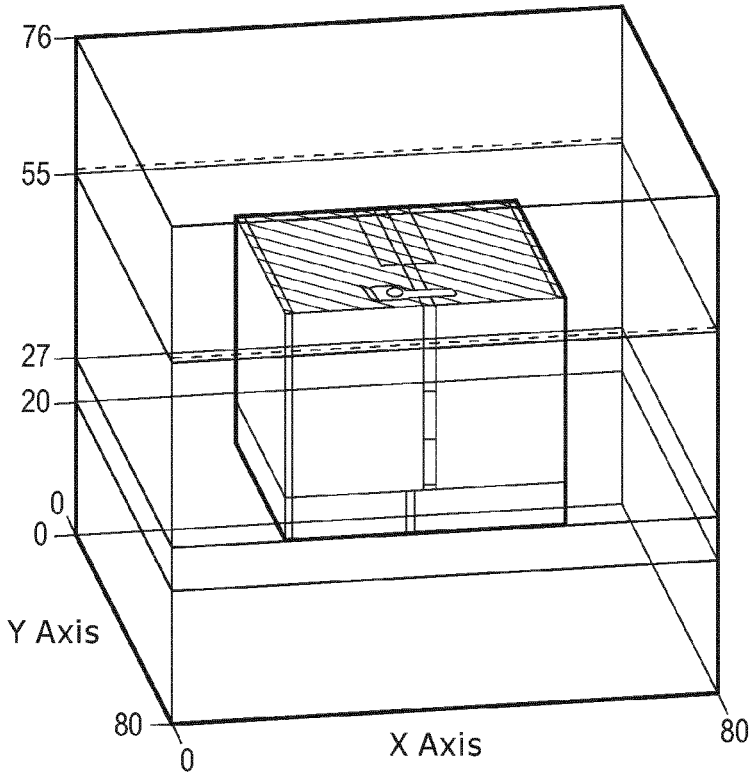
FIG. 10 shows a simulation model of the slot antenna on heat sink of FIG. 8.
Figure 11:
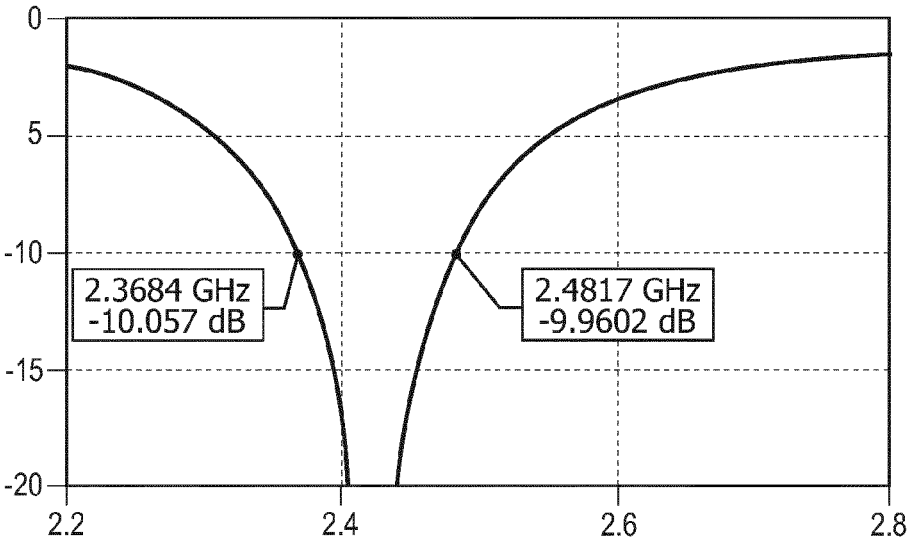
FIG. 11 shows the simulation result of the return loss based on the model as shown in FIG. 10.

The impedance of the slot antenna applied in a heat sink with dimensions suitable for a lamp was simulated. The simulation model shown in FIG. 10 is a rectangular representation needed due the limitations of the used electrical field simulation software. FIG. 11 shows the simulation result. The return loss simulation is very promising and shows an S11 value better than −10 dB over het whole Zigbee band with little sensitivity for tolerances on the slot dimensions. The x (horizontal) axis stands for frequency and the unit is GHz, and the y (vertical) axis stands for the loss and the unit is dB.

Figure 12:
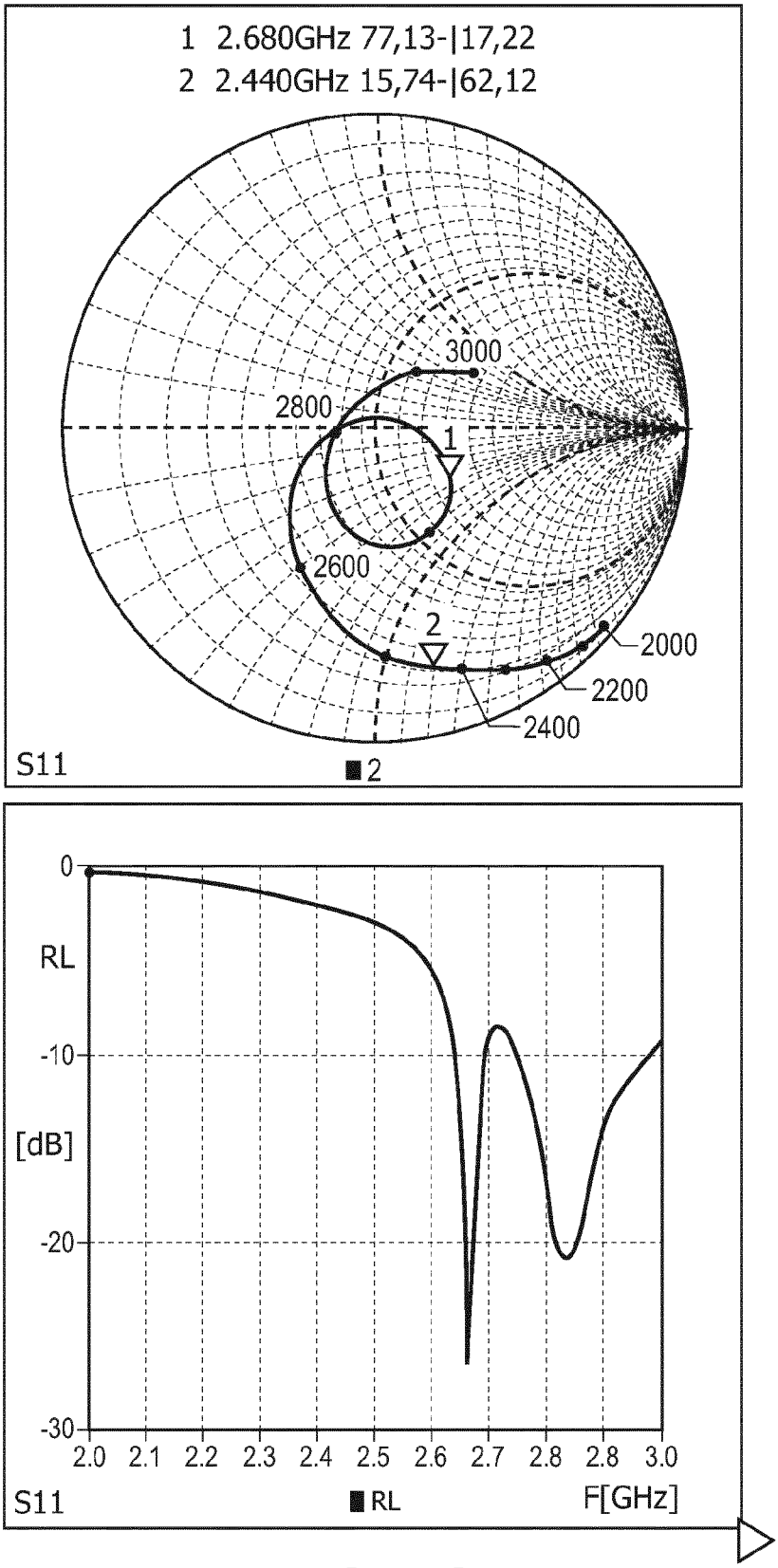
FIG. 12 shows the impedance measurement result of a prototype made according to the embodiment as shown in FIG. 8.

The inventor also builds a prototype and measures the impedance. The measurement is shown in FIG. 12. Two resonances were found using the prototype as is, 2.65 GHz in the feed and 2.83 GHz in the slot. Combined this results in a wide frequency range with S11<−10 dB. The location of this range still needs be tuned to the Zigbee band.

Figure 13:
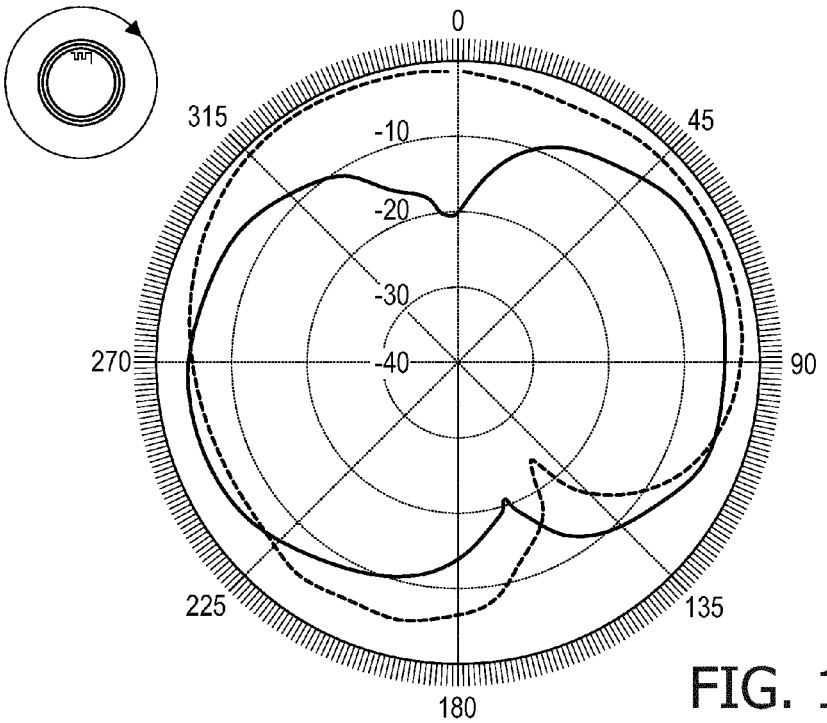
FIG. 13 shows the radiation pattern of the slot antenna on heat sink according to the embodiment as shown in FIG. 8.

The radiation pattern is what matters most for the practical use of the antenna. FIG. 13 shows a radiation pattern that is nicely uniform for both all polarizations. Wherein, the outer pattern is level horizontal, and the inner pattern is level vertical. This is advantageous for a lamp that has good RF performance independent of its orientation.

In practical implementation, the volume of the cylinder heat sink influences the bandwidth. A larger volume yields a higher bandwidth. Adding a dielectric material, other than air, into the enclosed cylinder heat sink will change the electrical antenna properties. The dielectric reduces the resonant length of slot, allowing for a smaller antenna. The tradeoff is that the bandwidth and efficiency typically decrease with a dielectric cavity medium.

The dielectric can also be used to shift the resonance frequency to an exact desired frequency. The bandwidth is increased by the dielectric while the best achievable return loss is reduced. Return loss should for our application be as low as possible over the whole frequency bandwidth the antenna should radiate. For example the Zigbee frequency band is form 2.405 GHz to 2.480 GHz.

Figure 14:
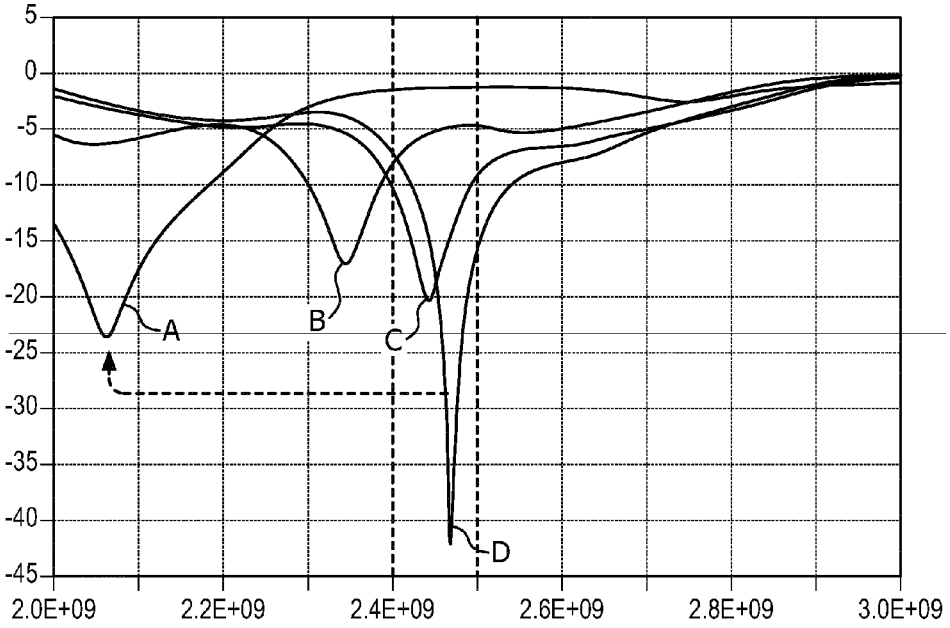
FIG. 14 shows the influence of dielectric material within the cavity of the heat sink on return loss.

Two examples for the influence on return loss are given. In the first example as shown in FIG. 14, a dielectric material called "potting" is used. IT will shift the resonance frequency by −400 MHz, will double the bandwidth and reduces the best achievable return loss by 32 dB. The curve B stands for no potting. The curve D stands for no potting and matching 1 pF+3.9 nH, wherein the 1 pF is a matching capacitor parallel to the antenna connection point and the 3.9 nH is a matching inductor in series with the antenna at ot's connection point. The value of these two components are adjusted to shift the dip in the curve inside the wanted Zigbee frequency band. So for the no potting situation a Cshunt=1 pF and Lseries=3.9 nH gives a dip that is slightly offset in the Zigbee band and not completely below −10 dB at the borders of the band. Using Cshunt=1.2 pF and Lseries=4.3 nH puts the curve nicely below −10 dB over the whole band for the no potting situation. Adding then potting gives curve A. The curve C stands for no potting and matching 1.2 pF+4.3 nH. The curve A stands for potting and matching 1.2 pF+4.3 nH. The dash lines indicate the boundaries of the ZigBee band.

Figure 15:
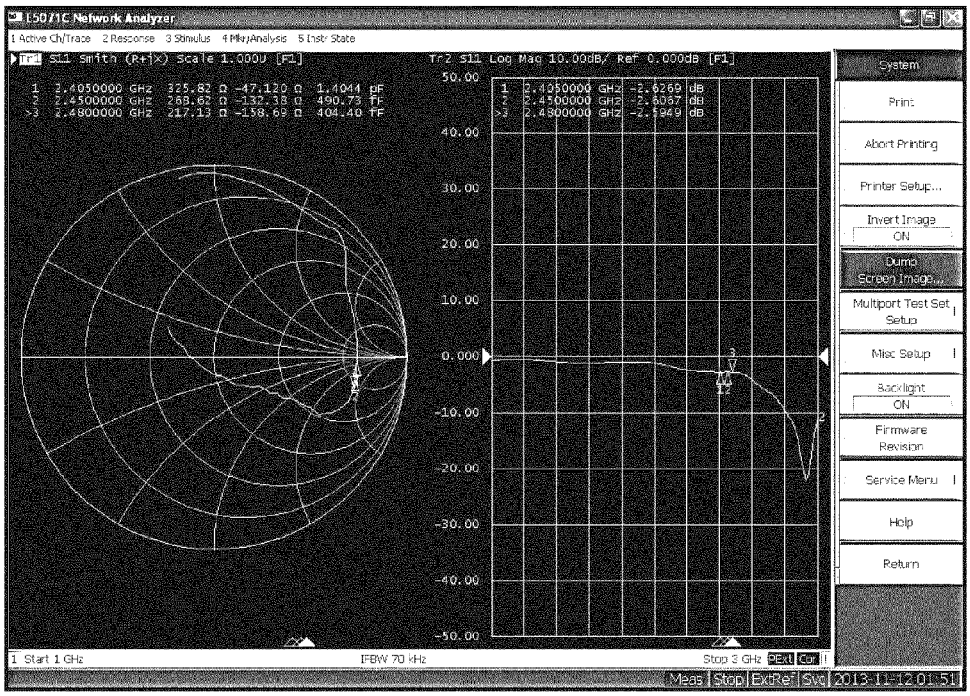
FIG. 15 shows the radiation pattern and return loss of a heat sink with antenna but without dielectric material.
Figure 16:
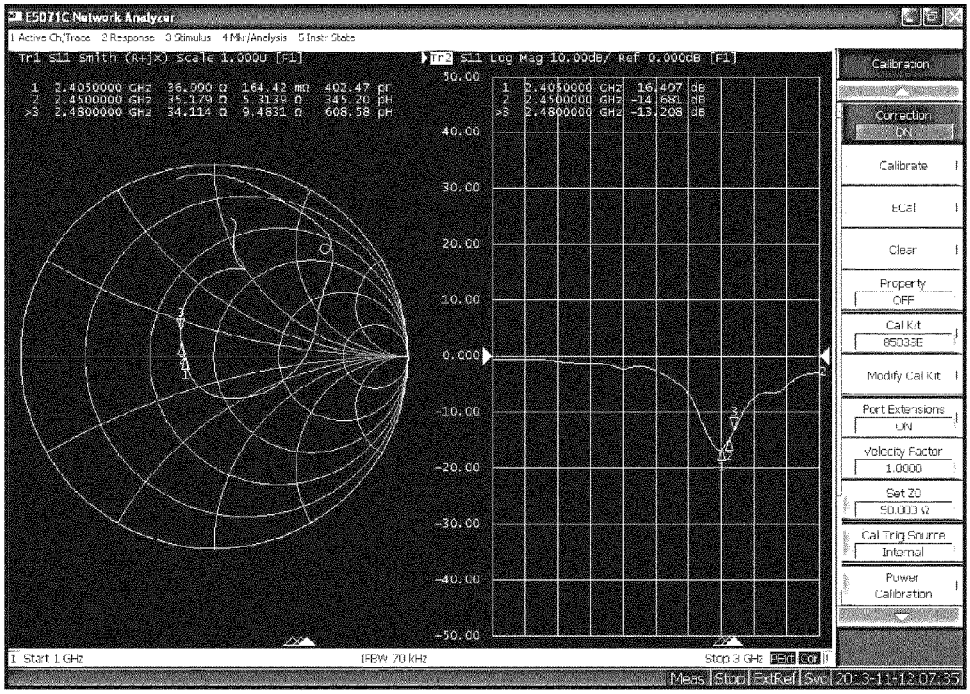
FIG. 16 shows the radiation pattern and return loss of a heat sink with antenna also with dielectric material.

A second example of S11 measurement without dielectric is shown in FIG. 15 while S11 with dielectric is shown in FIG. 16, and these measurements show a similar effect. As shown in FIG. 15, without dielectric the resonance is too high. And in FIG. 16, with dielectric the resonance is close to the desired frequency band. Again there is a large frequency shift (450 MHz), the dip is less deep and the antenna bandwidth is increased.

Summarized, the current application provides a lighting device 100, 102, 104, 106 and a luminaire 200. The lighting device 100, 102, 104, 106 comprises a light emitter 110 thermally connected to a heat sink 120. The lighting device 100, 102, 104, 106 further comprises a communication circuit 130 coupled to the heat sink 120 for transmitting and/or receiving a communication signal. A first conductive part 122 of the heat sink 120 comprises at least a first pole 142 of a dipole antenna 140 for transmitting and/or receiving the communication signal via the heat sink 120. This first pole 142 of the dipole antenna 140 may be induced via a primary radiator 160 to activate a gap 170 or a slot 175.

The term "dipole antenna" throughout the specification and claims intends to cover at least two kinds of antennas: one kind is with two physical antenna legs, each of which forms one pole of the antenna; another kind is other antenna type such as slot antenna which does not have the two physical antenna legs but can be equivalently analyzed as dipole antenna.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting device comprising:

a light emitter thermally connected to a heat sink, a communication circuit being coupled to the heat sink for transmitting and/or receiving a communication signal, a dipole antenna formed on the heat sink and a first conductive part of the heat sink comprising at least a first pole of the dipole antenna for transmitting and/or receiving the communication signal via the heat sink, a primary radiator arranged inside the heat sink and connected to the communication circuit for transmitting and/or receiving the communication signal inside the heat sink near a gap in the heat sink, the primary radiator being configured to activate the first conductive part around the gap to constitute a secondary radiator transmitting and/or receiving the communication signal outside the heat sink.

2. The lighting device according to claim 1, wherein the communication circuit is connected to a first mono-pole antenna having a ground-plate being coupled to the first conductive part of the heat sink.

3. The lighting device according to claim 2, wherein the first conductive part constitutes part of an outer wall of the heat sink, the first mono-pole antenna being arranged inside the heat sink coupled to the first conductive part.

4. The lighting device according to claim 2, wherein the first conductive part is electrically insulated from the remainder of the heat sink via a coupling element.

5. The lighting device according to claim 2, wherein the lighting device comprises a second mono-pole antenna arranged at an angle compared to the first mono-pole antenna to improve communication via antenna diversity.

6. The lighting device according to claim 1, wherein the primary radiator is a primary antenna arranged inside the heat sink, and/or wherein the lighting device comprises a transmission line coupled to the gap for transmitting the radiation of the primary radiator to the gap.

7. The lighting device according to claim 1, wherein the gap insulates the first conductive part from a second conductive part of the heat sink, the primary radiator being configured to also activate the second conductive part around the gap for constituting a second pole of the dipole antenna, the second pole together with the first pole in the first conductive part constituting the dipole antenna of the secondary radiator.

8. The lighting device according to claim 7, wherein a resonance frequency of the combination of the first pole and the second pole includes a signal frequency of the communication signal.

9. The lighting device according to claim 7, wherein a dimension and/or mass of the second conductive part is different compared to the first conductive part for adapting a polarization direction of the signal emitted from the heat sink.

10. The lighting device according to claim 1, wherein the gap comprises a slot in the first conductive part, the slot being the secondary radiator having a resonance frequency including the signal frequency of the communication signal.

11. The lighting device according to claim 10, wherein a length of the gap is substantially equal to half of the wavelength of the communication signal, and a width of the gap is less than 5% of the wavelength of the communication signal.

12. The lighting device according to claim 10, wherein the slot comprises a signal feed for feeding the communication signal to the slot.

13. The lighting device according to claim 10, wherein the first conductive part comprises a further slot having similar dimensions as the slot for generating an antenna array.

14. The lighting device according to claim 10, wherein the heat sink comprising a first plane and a second plane angled with respect to the first plane, and the slot is extending from the first plane to the second plane.

15. The lighting device according to claim 14, wherein the heat sink comprising a back plane opposite the slot and the primary radiator, and the distance between the back plane and the primary radiator is quarter of the wavelength of the communication signal.

16. The lighting device according to claim 15, further comprising dielectric material between the primary radiator and the back plane; and wherein the heat sink is of a cylinder shape, and the slot extends from the lateral wall to the top wall of the cylinder heat sink; and wherein the primary radiator is placed at the middle of the length of the slot.

17. A luminaire comprising the lighting device according to claim 1.

* * * * *